United States Patent [19]

Ashton

[11] 3,979,208

[45] Sept. 7, 1976

[54] DUCTILE ALUMINUM BRONZE ALLOY AND ARTICLE

[75] Inventor: Norman Coupe Ashton, Huddersfield, England

[73] Assignee: N. C. Ashton Limited, Huddersfield, England

[22] Filed: Sept. 11, 1974

[21] Appl. No.: 505,019

Related U.S. Application Data

[63] Continuation-in-part of Ser. No. 394,625, Sept. 6, 1973, abandoned.

[52] U.S. Cl. ..... 75/154; 29/183; 75/153; 75/162

[51] Int. Cl.[2] ..... C22C 9/00

[58] Field of Search ..... 75/153, 154, 162; 148/11.5, 32; 29/183, 193; 85/1 R; 292/2

[56] References Cited

UNITED STATES PATENTS

| | | | |
|---|---|---|---|
| 1,718,502 | 6/1929 | Vaders | 75/154 |
| 2,046,702 | 7/1936 | Scott | 75/154 |
| 2,130,737 | 9/1938 | Hensel et al. | 75/154 |
| 2,210,670 | 8/1940 | Kelly | 75/154 |
| 2,210,671 | 8/1940 | Kelly | 75/154 |
| 2,210,673 | 8/1940 | Kelly | 75/154 |
| 2,286,734 | 6/1942 | Harrington | 75/154 |
| 2,829,968 | 4/1958 | Klement | 75/154 |
| 2,829,969 | 4/1958 | Klement | 75/154 |
| 3,905,810 | 9/1975 | Ashton | 75/154 |

FOREIGN PATENTS OR APPLICATIONS

| | | | |
|---|---|---|---|
| 519,902 | 4/1940 | United Kingdom | 75/162 |

OTHER PUBLICATIONS

Metals Handbook, 1961–1968 Ed., vol. 1, p. 1034.

*Primary Examiner*—Walter R. Satterfield
*Attorney, Agent, or Firm*—Norris & Bateman

[57] ABSTRACT

An aluminum bronze alloy for forming corrosion resistant articles by cold working, the alloy comprising by weight 5% to 8% Aluminum, 0.1% to 2% Cobalt and 0.10% to 0.25% Tin, which latter may be replaced by an equal amount of Silver, and the balance being Copper and impurities.

7 Claims, No Drawings

DUCTILE ALUMINUM BRONZE ALLOY AND ARTICLE

This is a continuation-in-part of Ser. No. 394,625 filed Sept. 6, 1973 and now abandoned.

This invention relates to an aluminium bronze alloy and has for its object, the provision of an alloy which is capable of cold forming. It will be appreciated that in order to sustain cold forming, and at the same time be resistant to corrosive atmospheres, it is desirable that the alloy has high ductility and is effective against stress corrosion.

According to one aspect of this invention, an aluminium bronze alloy comprises by weight 5% to 8% aluminium, 0.1% to 2% cobalt, 0.10% to 0.25% tin and at least substantially the balance being copper and any impurities.

Preferably, the aluminium bronze alloy comprises by weight 7% aluminium, 0.45% cobalt and 0.21% tin. Alternatively, the aluminium bronze alloy may comprise by weight 7% aluminium, 0.83% cobalt and 0.21% tin.

The tin may be substituted at least in part by an equal weight of silver and the alloy may also include iron in the range 0.01% to 0.10% by weight.

According to another aspect of this invention, an article is formed from an aluminium bronze alloy according to said one aspect of this invention, and may comprise a screw-threaded securing member such as, for example, a bolt, a setscrew, a stud or the like.

Preferably, the member is formed by a cold working operation such as, for example, rolling, forging or thread rolling.

This invention will now be described, by way of example only, with reference to two specific examples of the alloy.

Each of the two examples of the aluminium bronze alloy are prepared by melting the metals together in the requisite proportions in the conventional manner, the cobalt being added in the form of copper-base master alloys. The alloys are cast in billets and hot worked into suitable strip or bar which is then subjected to heat treatment.

The heat treatment may consist of a solution treatment between 800°C and 900°C, in these two examples the solution treatment was carried out for ¾ hour at approximately 800°C, and the cooling rate, being critical depends upon the thickness of the cross section of the material. This may involve air cooling or quenching in water or oil, for example to obtain optimum properties, materials exceeding ⅛ inch in thickness should be water or oil quenched and materials having a thickness not exceeding ⅛ inch should be air-cooled. The test specimens for the two examples of the alloy were hot rolled bar of 13/16 inch diameter and were quenched in oil.

The material may be precipitation-hardened in the range 400°C to 600°C either directly or following cold working operations and the test specimens for the two examples of the alloy were precipitation-hardened for 8 hours at approximately 450°C both directly after the solution treatment and also after 15% cold work by drawing.

In the first example, the aluminium bronze alloy consists by weight of 7.03% aluminium, 0.45% cobalt, 0.18% tin the balance being copper and the usual impurities. Tests were carried out on 13/16 inch diameter hot rolled bar specimens of the alloy and the following results were obtained:

| Condition | 0.1% Proof Stress tons/sq in | Ultimate tensile strength tons/sq in | % Elongation on 2 inches | IZOD ft/lbs | Hardness Vickers Pyramid Hardness No.: | | |
|---|---|---|---|---|---|---|---|
| | | | | | Centre | Mid Radius | Edge |
| Rolled and Solution Treated | 12.8 | 30.7 | 56 | 83/88/92 | 109 | 109 | 110 |
| Rolled, Solution Treated and Precipitation Hardened | 16.8 | 32.6 | 56.5 | 79/80/80 | 124 | 125 | 125 |
| Rolled, Solution treated and 15% Cold Work by drawing | 19.9 | 35.8 | 43 | 79/80/82 | 175 | 184 | 191 |
| Rolled, Solution, Treated, 15% Cold Work by drawing and Precipitation Hardened | 27.4 | 38.2 | 40.0 | 68/67/70 | 187 | 197 | 201 |

These test results clearly show that the material has an unexpectedly high ductility particularly at the upper values of tensile strength obtained as exhibited by the % elongation and the IZOD test values in the above table. The surprising nature of these results will be appreciated more clearly when they are compared to the results which had previously been obtained on specimens formed of a similar alloy which did not include tin. This alloy consisted by weight of 7% aluminium, 0.5% cobalt the balance being copper and the following results were obtained on specimens which had been solution treated at 800°C and subjected to 15% cold work, and specimens which had in addition been fully aged:

| Condition | 0.1% Proof Stress tons/sq in | Ultimate tensile strength | % Elongation | Hardness Vickers Pyramid Hardness No.: |
|---|---|---|---|---|
| Solution treated and 15% cold work | 22.5 | 32 | 22% | 147 |
| Solution treated, 15% cold work and fully aged | 25.0 | 36.5 | 24% | 168 |

A comparison of these results on the alloy without tin to the results obtained on specimens which were in the same condition but formed of the alloy including tin clearly show the surprising improved ductility of the material when tin is added which is exhibited by the improvement in the % elongation from 20/24% to 40/43%. This improved ductility of the alloy when tin is included is also obtained even though the hardness of the alloy including tin is greater than the hardness of the alloy without tin.

In the second example, the aluminium bronze alloy consists by weight of 6.98% aluminium, 0.83% cobalt, 0.21% tin the balance being copper and the usual impurities. Tests were carried out on 13/16 inch diameter hot rolled bar specimens of the alloy and the following results were obtained:

| Condition | 0.1% Proof Stress tons/sq in | Ultimate tensile strength tons/sq in | % Elongation on 2 inches | IZOD ft/lbs | Hardness Vickers Pyramid Hardness No: | | |
|---|---|---|---|---|---|---|---|
| | | | | | Centre | Mid Radius | Edge |
| Rolled and Solution Treated | 15.0 | 33.1 | 51% | 80/86/83 | 133 | 29 | 125 |
| Rolled, Solution Treated and Precipitation Hardened | 16.2 | 33.2 | 51% | 75/77/76 | 133 | 130 | 129 |
| Rolled, Solution Treated and 15% Cold Work by drawing | 21.8 | 39.7 | 36% | 66/66/66 | 197 | 203 | 209 |
| Rolled, Solution Treated 15% Cold Work by drawing | 33.3 | 42.5 | 32% | 40/42/40 | 216 | 223 | 224 |

The alloys described in these two examples have a high notch ductility as exhibited by the % elongation and the IZOD values in the above test results and this makes the alloys particularly suitable for forming bolts, setscrews, studs or other screw-threaded securing members by cold working operations such as rolling, forging and thread rolling in a conventional manner.

In addition, the addition of tin in these examples of the alloy not only improves the ductility of the material but also inhibits stress corrosion and these properties of the material makes the alloy particularly suitable for forming screw-threaded securing members, such as bolts, which are to be used in open air and corrosive conditions, for example, on motorway crash barriers. It is believed that the addition of tin to aluminum bronze alloy containing cobalt in accord with the foregoing affects the precipitation hardening mechanism of the alloy and suppresses the grain growth during solution treatment, thereby resulting in an alloy having a finer grain and higher ductility than hitherto known alloys of this type. Although it is preferred to use tin, it is possible to replace the tin content with an equivalent content by weight of mixtures of tin and silver and if there is an appreciable quantity of silver present in the copper then it may be possible to reduce the tin added by a corresponding amount.

It is also possible for iron to be included or be present in the alloy in the range 0.01% to 0.10% by weight.

I claim:

1. An aluminum bronze alloy of improved ductility consisting essentially by weight of 5% to 8% aluminum; 0.1% to 2% cobalt; not more than 0.10% iron; 0.10% to 0.25% tin; and a balance of copper and impurities associated with copper.

2. An aluminium bronze alloy according to claim 1 containing by weight 7% aluminium, 0.45% cobalt and 0.18% tin.

3. An aluminium bronze alloy according to claim 1, containing by weight 7% aluminium, 0.83% cobalt and 0.21% tin.

4. An article formed from an aluminium bronze alloy according to claim 1.

5. An article according to claim 4, comprising a screw-threaded securing member.

6. An article according to claim 4, which is formed by a cold working operation.

7. An integral corrosion resistant screw threaded securing member of improved ductility formed from an aluminum bronze alloy consisting essentially by weight of 5% to 8% aluminum; 0.1% to 2% cobalt; 0.10% to 0.25% tin; not more than 0.10% iron; and the balance of copper and impurities associated with copper; and further characterized by having been cold worked at least 15%.

* * * * *